US011779058B1

(12) United States Patent
Knutson et al.

(10) Patent No.: US 11,779,058 B1
(45) Date of Patent: Oct. 10, 2023

(54) FOOTWEAR SYSTEM WITH RESTRICTED AMBULATION HINDFOOT LONGITUDINAL SLIDE

(71) Applicants: Greg Knutson, Saint Paul, MN (US); James Johansson, Saint Paul, MN (US)

(72) Inventors: Greg Knutson, Saint Paul, MN (US); James Johansson, Saint Paul, MN (US)

( * ) Notice: Subject to any disclaimer, the term of this patent is extended or adjusted under 35 U.S.C. 154(b) by 752 days.

(21) Appl. No.: 15/262,557

(22) Filed: Sep. 12, 2016

Related U.S. Application Data

(60) Provisional application No. 62/218,065, filed on Sep. 14, 2015.

(51) Int. Cl.
*A41B 11/00* (2006.01)
*A43B 17/18* (2006.01)

(52) U.S. Cl.
CPC ..... *A41B 11/007* (2013.01); *A43B 17/18* (2013.01); *A41B 2400/80* (2013.01)

(58) Field of Classification Search
CPC ..... A41B 11/007; A41B 11/10; A41B 11/008; A43B 17/18; A43B 3/244; A43B 3/246
USPC ..... 2/239, 241; 36/101, 15
See application file for complete search history.

(56) References Cited

U.S. PATENT DOCUMENTS 3,810,318 A * 5/1974 Epstein ..... A43B 5/00 36/105
4,169,324 A 10/1979 Gibbs
4,187,619 A * 2/1980 Gibbs ..... A43B 17/18 2/240
4,279,083 A * 7/1981 Dilg ..... A43B 13/36 36/101
4,301,604 A * 11/1981 Hamilton ..... A43B 5/18 36/130
4,317,292 A * 3/1982 Melton ..... A41B 11/007 36/9 R
4,575,954 A * 3/1986 Bye ..... A61F 5/0111 2/240
5,092,347 A * 3/1992 Shaffer et al. ..... A61F 13/064 128/892
5,144,759 A * 9/1992 Mascotte ..... A43B 3/16 36/7.1R
5,396,718 A * 3/1995 Schuler et al. ..... A43B 21/26 36/27
5,499,459 A 3/1996 Tomaro
5,694,704 A * 12/1997 Kasbrick ..... A43B 3/16 36/59 R
6,880,268 B2* 4/2005 Chen ..... A43B 3/128 36/43
7,010,872 B2* 3/2006 Pawlus et al. ..... A43B 3/0047 36/100
7,434,336 B2* 10/2008 Kosted ..... A43B 1/0081 36/10
7,591,084 B2* 9/2009 Santa Ana ..... A43B 1/0054 36/100
7,908,774 B2* 3/2011 Mirza et al. ..... A43B 1/0036 36/137
2004/0088883 A1* 5/2004 Workman ..... A43B 13/36 36/15
2005/0274042 A1* 12/2005 Issler ..... A43B 13/28 36/15

(Continued)

FOREIGN PATENT DOCUMENTS

WO 01/65959 A1 9/2001

*Primary Examiner* — Heather Mangine
(74) *Attorney, Agent, or Firm* — SHERRILL LAW OFFICES, PLLC

(57) ABSTRACT

A footwear system for controlling longitudinal sliding of a shoe over the hindfoot of a wearer during ambulation that includes an insole with a tether, a compression sock, and hook and loop tape for attaching the heel end of the insole to a heel flap portion of the compression sock.

6 Claims, 3 Drawing Sheets

(56) References Cited

U.S. PATENT DOCUMENTS

| | | | | |
|---|---|---|---|---|
| 2006/0248748 | A1* | 11/2006 | Warren | A43B 13/226 36/9 R |
| 2007/0011917 | A1* | 1/2007 | Hayes | A43B 3/24 36/105 |
| 2007/0062067 | A1* | 3/2007 | Covatch | A43B 3/24 36/55 |
| 2007/0227039 | A1* | 10/2007 | Chaney et al. | A43B 5/08 36/15 |
| 2007/0271819 | A1* | 11/2007 | Chen | A41B 11/008 36/43 |
| 2008/0005927 | A1* | 1/2008 | Hung | A43B 13/36 36/15 |
| 2008/0289222 | A1* | 11/2008 | Candrian et al. | A43B 13/22 36/101 |
| 2012/0117817 | A1* | 5/2012 | Chamberlin | A43B 1/0081 36/15 |
| 2012/0227289 | A1* | 9/2012 | Beers et al. | A43B 3/246 36/25 R |
| 2013/0086817 | A1* | 4/2013 | Myerscough | A43B 3/06 36/114 |
| 2013/0212908 | A1* | 8/2013 | Hsu | A43B 13/189 36/101 |
| 2013/0269218 | A1* | 10/2013 | Blumenaus | A43B 23/28 36/136 |
| 2014/0026438 | A1* | 1/2014 | Cortez et al. | A43B 13/184 36/28 |
| 2014/0041257 | A1* | 2/2014 | Robinson | A43B 3/244 36/100 |
| 2014/0215854 | A1* | 8/2014 | Girard | A43C 11/12 36/114 |
| 2014/0345162 | A1* | 11/2014 | Mitchell | A43B 1/0081 36/100 |
| 2015/0305442 | A1* | 10/2015 | Ravindran | A43B 23/28 36/138 |
| 2017/0231324 | A1* | 8/2017 | Arquilla et al. | A43B 1/009 36/10 |
| 2018/0289099 | A1* | 10/2018 | Bell et al. | A43B 3/06 |

* cited by examiner

FOOTWEAR SYSTEM WITH RESTRICTED AMBULATION HINDFOOT LONGITUDINAL SLIDE

BACKGROUND

Athletic performance wear is clothing and clothing accessories that enhance athletic performance and/or reduce injury during athletic performance. Performance wear is highly desired and prized by athletes around the world.

Footwear is one type of athletic wear that has long been the subject of substantial design efforts to improve athletic performance. While tremendous strides have been made over the years to improve the form, fit and function of athletic shoes, a need still exists for athletic shoes capable of providing an improved athletic performance.

SUMMARY OF THE INVENTION

The invention is a footwear system for controlling longitudinal sliding of a shoe over the hindfoot of a wearer during ambulation, particularly during an athletic performance where speed is desired. The system includes an insole with a tether, a compression sock, and hook and loop tape for attaching the insole and the sock. The tether is attached to and extends from the posterior end of the insole. The hook and loop tape has a first portion secured to the tether and a second portion secured to a heel flap portion of the compression sock.

The first and second portions of the tape are preferrably configured and arranged to achieve attachment of the first and second portions with the tether taut between the point of attachment of the tether to the insole and the point of attachment of the tether to the compression sock when the attached system is worn with the shoe.

DETAILED DESCRIPTION OF A PREFERRED EMBODIMENT

| Nomenclature | |
|---|---|
| REFERENCE No. | NAME |
| **10** | Footwear System |
| **20** | Insole |
| **20***a* | Top Surface of Insole |
| **20***b* | Bottom Surface of Insole |
| **20***c* | Toe End of Insole |
| **20***d* | Heel End of Insole |
| **30** | Tether |
| $\mathbf{30}_{p1}$ | Point of Attachment of Tether to Insole |
| $\mathbf{30}_{p2}$ | Point of Attachment of Tether to Sock |
| **40** | Compression Sock |
| **41** | Sole Area of Compression Sock |
| **42** | Heel Flap Area of Compression Sock |
| **43** | Leg Area of Compression Sock |
| **50** | Hook and Loop Tape |
| $\mathbf{50}_1$ | First Portion of Hook and Loop Tape |
| $\mathbf{50}_2$ | Second Portion of Hook and Loop Tape |
| **60** | Fastener for Securing Insole to Shoe |
| x | Longitudinal Direction |

-continued

| Nomenclature | |
|---|---|
| REFERENCE No. | NAME |
| F | Human Foot |
| $F_1$ | Hindfoot of Human Foot |
| S | Shoe |

Figure 1:
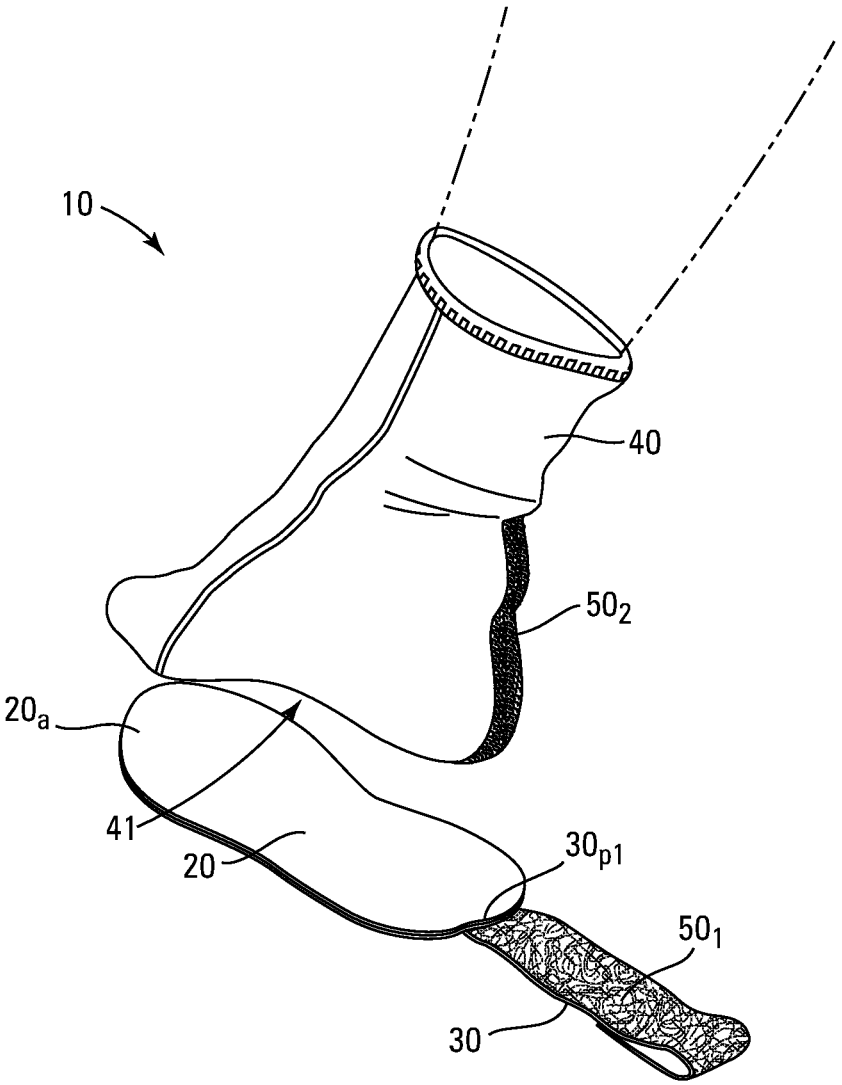
FIG. 1 is a perspective view of one embodiment of the invention prior to attachment of the hook and loop tape.
Figure 2:
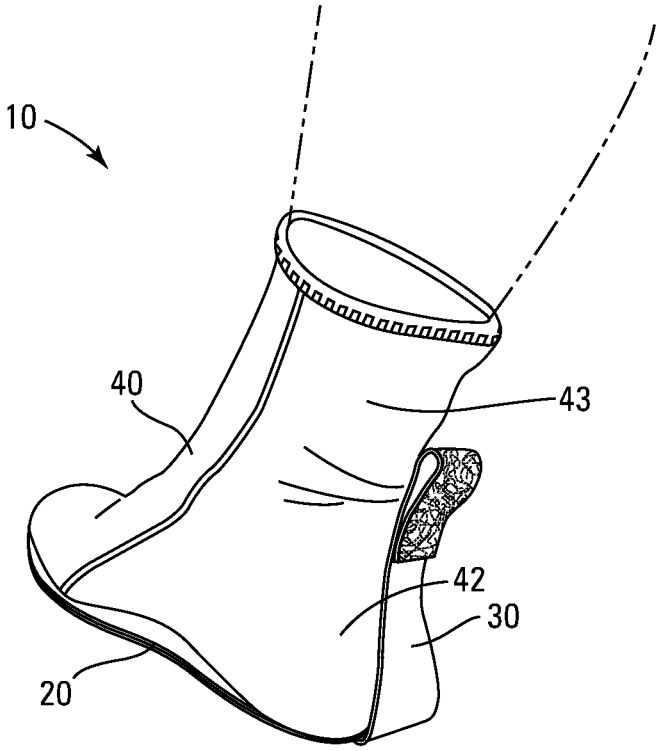
FIG. 2 is a perspective view of the invention depicted in FIG. 1 with the hook and loop tape attached.
Figure 3:
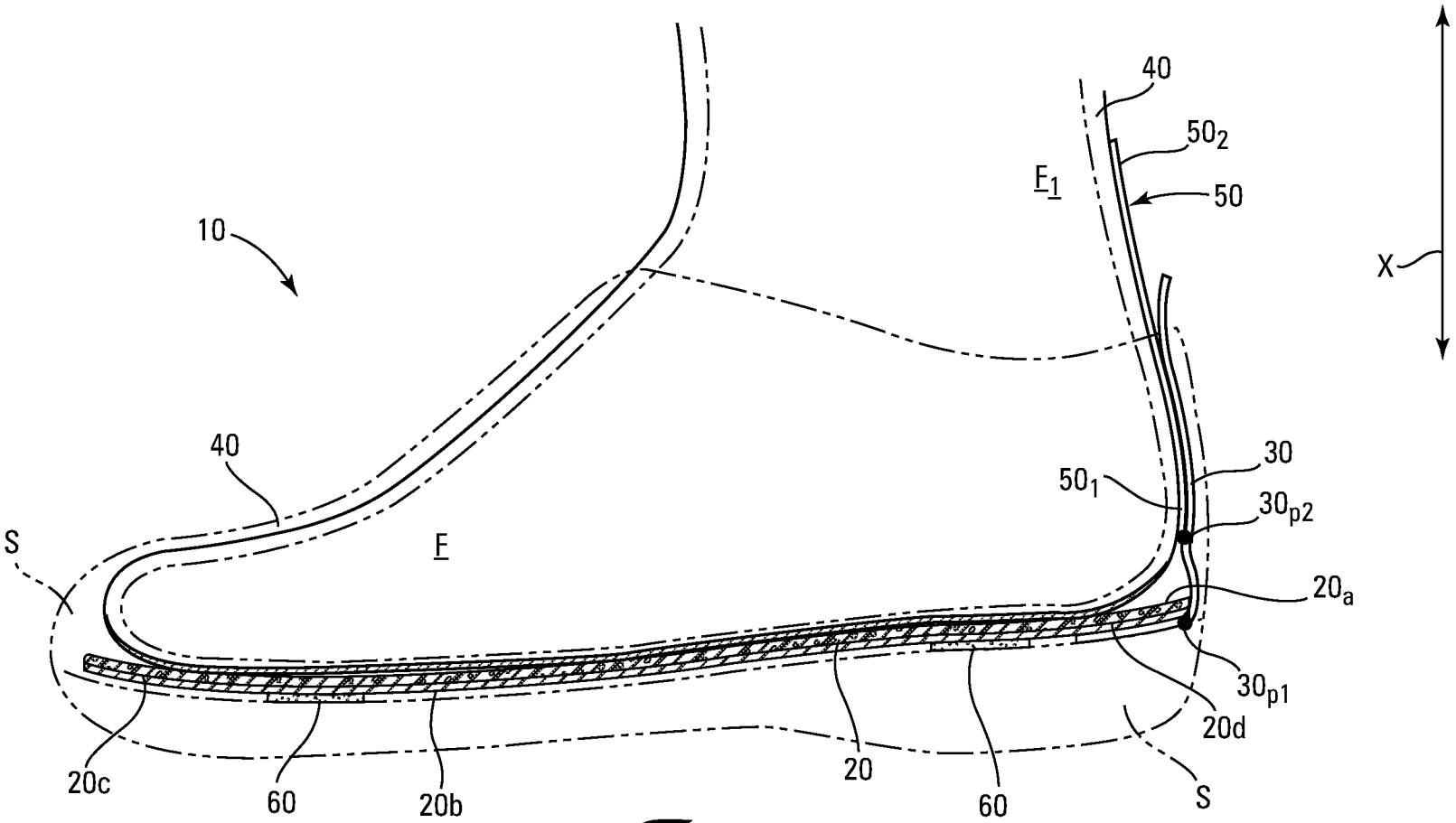
FIG. 3 is a cross-sectional side view of the invention depicted in FIGS. 1 and 2 worn in a shoe.

Referring to FIGS. 1-3, the invention is a footwear system 10 capable of controlling longitudinal x sliding of a shoe S over the hindfoot $F_1$ of a wearer (not fully shown) during ambulation, particularly during an athletic performance where speed is desired. The system 10 includes an insole 20 with a tether 30, a compression sock 40, and hook and loop tape 50 for releasably attaching the insole 20 and the sock 40.

The insole 20 may be constructed in accordance with any of the commonly available insoles, such as those constructed of ethylene vinyl acetate foam. The insole 20 has a top surface 20*a*, a bottom surface 20*b*, a toe end 20*c* and a heel end 20*d*.

The tether 30 is permanently or releaseably attached to the insole 20 at a first point of attachment $\mathbf{30}_{p1}$ by any suitable fastening means such as stitching, hook and loop tape or double sided adhesive tape. The tether 30 extends rearward from the heel end 20*d* of the insole 20. The tether 30 is preferrably an inelastic stretch resistant strap.

The sock 40 is a compression sock or compression sleeve, meaning the sock 40 forms a tight compressive fit over the foot F of a wearer so that the sock 40 does not appreciably shift relative to the foot F during normal ambulation. The ubiquitous neoprene socks and athletic compression socks, typically manufactured from various combinations of nylon, cotton, spandex and natural and synthetic rubber, are generally suitable for use in the invention.

A first portion $\mathbf{50}_1$ of the hook and loop tape 50 is secured to the tether 30. The second portion $\mathbf{50}_2$ of the hook and loop tape 50 is secured to a heel flap area 42 of the compression sock 40. Both the first portion $\mathbf{50}_1$ and the second portion $\mathbf{50}_2$ preferably extend along the midsaggital plane. The first $\mathbf{50}_1$ and second $\mathbf{50}_2$ portions of the tape 50 may be configured and arranged on the tether 30 and the sock 40 with or without a gap between the point of attachment of the tether to the insole $\mathbf{30}_{p1}$ and the point of attachment $\mathbf{30}_{p2}$ of the tether 30 to the compression sock 40 when the hook and loop tape 50 is attached and the system 10 is worn in a shoe S. When such a gap is provided, the first $\mathbf{50}_1$ and second $\mathbf{50}_2$ portions of the tape 50 are preferrably configured and arranged so that the tether 30 can be pulled taut within the gap when the tape 50 is attached and the system 10 worn in a shoe S.

Fastening means other than hook and loop tape 50 may be employed to secure the tether 30 to the sock 40, such as releasable adhesive tape, but for superior performance over an extended period of use, hook and loop tape is preferred.

The insole 20 may be permanently or releasably secured in position inside the shoe S by any suitable fastening means 60, such as stitching or double sided adhesive tape.

The top surface 20*a* of the insole 20 and/or the bottom surface of the sole area 41 of the compression sock 40 can be provided with continuous or patterned anti-skid tread, such as a nitrile composite, a polyvinyl chloride (PVC) material, a propylene-based elastomer (PBE) material, or any other conventionally know rubber material having a sufficiently high coefficient of friction, to restrict slippage of the sock 40 across the surface of the insole 20.

The system 10 controls the normal reciprocating longitudinal x sliding of the shoe S over the hindfoot $F_1$ of a wearer during ambulation, particularly during running, thereby reducing the extent to which such sliding, which tends to occur during the terminal stance and pre-swing phases of a gate cycle, diminishes the horizontal or forward force generated during the stance phase of each gate cycle.

We claim:

1. A footwear system for use in combination with a shoe having a shoe upper configured and arranged to enclose at least a hindfoot of a wearer so as to control longitudinal sliding of the shoe over the hindfoot of the wearer during ambulation, the system comprising:

(a) an insole for the shoe, the insole configured and arranged for placement within the shoe, having a toe end and a heel end, and a top surface comprising a material selected from a group consisting of ethylene vinyl acetate, nitrile composite, polyvinyl chloride, propylene-based elastomer, and rubber, (b) a tether attached to and extending from the heel end of the insole at a first point of attachment, (c) a compression sock having a bottom surface, a heel flap portion and a leg portion, whereby the bottom surface of the compression sock directly engages the material of the top surface of the insole when the footwear system is worn, and (d) hook and loop tape with a first portion secured to the tether and a second portion secured to the compression sock operable for releasable attachment of the tether to the compression sock at a second point of attachment different from the first point of attachment, (e) whereby longitudinal sliding of the shoe upper over the hindfoot of the wearer during ambulation is controlled when the tether is attached to the compression sock.

2. The footwear system according to claim 1 wherein a gap exists between the first point of attachment and the second point of attachment when the tether is attached to the compression sock during use, and the first and second portions of the hook and loop tape are configured and arranged to allow attachment of the first and second portions with the tether taut within said gap when the system is worn with the shoe.

3. The footwear system according to claim 1 wherein the tether is a stretch-resistant strap.

4. The footwear system according to claim 1 wherein the second portion of the hook and loop tape is secured to the heel flap portion of the compression sock.

5. The footwear system according to claim 1 wherein the second portion of the hook and loop tape is secured to the leg portion of the compression sock.

6. A footwear system, comprising:

(a) a shoe having integrally formed upper and sole portions with the upper portion configured and arranged to enclose at least a hindfoot of a wearer, (b) an insole for the shoe, the insole configured and arranged for insertion within the shoe, having a toe end and a heel end, and a top surface comprising a material selected from a group consisting of ethylene vinyl acetate, nitrile composite, polyvinyl chloride, propylene-based elastomer, and rubber, (c) a tether attached to and extending from the heel end of the insole at a first point of attachment, (d) a compression sock having a bottom surface, a heel flap portion and a leg portion, whereby the bottom surface of the compression sock directly engages the material of the top surface of the insole when the footwear system is worn, and (e) hook and loop tape with a first portion secured to the tether and a second portion secured to the compression sock operable for releasable attachment of the tether to the compression sock at a second point of attachment different from the first point of attachment, (f) whereby longitudinal sliding of the shoe upper over the hindfoot of the wearer during ambulation is controlled when the tether is attached to the compression sock.

* * * * *